US008241076B2

(12) United States Patent
Kubota

(10) Patent No.: US 8,241,076 B2
(45) Date of Patent: Aug. 14, 2012

(54) FEMALE TERMINAL FITTING

(75) Inventor: Motoki Kubota, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 130 days.

(21) Appl. No.: 12/896,934

(22) Filed: Oct. 4, 2010

(65) Prior Publication Data

US 2011/0086557 A1 Apr. 14, 2011

(30) Foreign Application Priority Data

Oct. 9, 2009 (JP) ..... 2009-234873

(51) Int. Cl.
*H01R 11/22* (2006.01)

(52) U.S. Cl. ..... 439/852

(58) Field of Classification Search ..... 439/851, 439/852, 853, 854
See application file for complete search history.

(56) References Cited

U.S. PATENT DOCUMENTS

| | | | | |
|---|---|---|---|---|
| 4,699,444 | A * | 10/1987 | Isohata | 439/839 |
| 5,350,321 | A * | 9/1994 | Takenouchi | 439/839 |
| 5,593,328 | A * | 1/1997 | Okada et al. | 439/851 |
| 5,658,173 | A * | 8/1997 | Genta | 439/752.5 |
| 5,733,155 | A * | 3/1998 | Sagawa | 439/852 |
| 5,788,542 | A * | 8/1998 | Miwa | 439/851 |
| 5,857,857 | A * | 1/1999 | Fukuda | 439/188 |
| 6,024,612 | A * | 2/2000 | Myer et al. | 439/852 |
| 6,062,918 | A * | 5/2000 | Myer et al. | 439/839 |
| 6,095,873 | A * | 8/2000 | Muramatsu et al. | 439/852 |
| 6,264,509 | B1 * | 7/2001 | Kwang et al. | 439/852 |
| 6,293,833 | B1 * | 9/2001 | Kamath | 439/851 |
| 6,416,366 | B2 * | 7/2002 | Endo et al. | 439/851 |
| 6,478,636 | B1 | 11/2002 | Makita et al. | |
| 6,790,100 | B2 * | 9/2004 | Nankou et al. | 439/851 |
| 6,932,625 | B2 * | 8/2005 | Yagi et al. | 439/76.2 |
| 6,971,927 | B2 * | 12/2005 | Anbo et al. | 439/852 |
| 7,229,329 | B2 * | 6/2007 | Yamashita et al. | 439/852 |
| 7,371,133 | B1 * | 5/2008 | Morello et al. | 439/852 |
| 7,381,104 | B2 * | 6/2008 | Rehbein et al. | 439/852 |
| 7,419,411 | B2 * | 9/2008 | Kaneko | 439/852 |
| 7,458,864 | B2 * | 12/2008 | Philipp | 439/851 |
| 7,513,806 | B2 | 4/2009 | Noda et al. | |
| 7,856,712 | B2 * | 12/2010 | Busies et al. | 29/882 |
| 2007/0218763 | A1 | 9/2007 | Rehbein et al. | |
| 2008/0280507 | A1 | 11/2008 | Noda et al. | |
| 2011/0086557 | A1 * | 4/2011 | Kubota | 439/842 |
| 2012/0034827 | A1 * | 2/2012 | Ishikawa et al. | 439/850 |

* cited by examiner

*Primary Examiner* — Neil Abrams
(74) *Attorney, Agent, or Firm* — Gerald E. Hespos; Michael J. Porco

(57) ABSTRACT

A female terminal fitting (10) has a tubular main portion (11) with first and second opposed resilient pieces (21, 24) formed therein. The second resilient piece (24) has an extending piece (25), a support (26) and a pressing piece (27). The support (26) contacts the inner surface of the main portion (11) and the pressing piece (27) extends from the support (26) to hold the first resilient piece (21) in a pre-loaded state. A tab (60) is inserted between the extending piece (25) and the first resilient piece (21) to incline the pressing piece (27) about the support (26) and to release the pre-loaded state. The extending piece (25) resiliently deforms about the support (26) and toward the tab (60) as the pressing piece (27) is inclined. Thus, the tab (60) is held resiliently between the extending piece (25) and the first resilient piece (21). With this arrangement, the tab (60) may be inserted at low frictional force but at complete insertion is held tightly be increased frictional force.

10 Claims, 3 Drawing Sheets

FBD

FEMALE TERMINAL FITTING

BACKGROUND OF THE INVENTION

1. Field of the Invention

The invention relates to a female terminal fitting.

2. Description of the Related Art

U.S. Pat. No. 7,513,806 discloses a female terminal fitting that has a tubular main portion for receiving a tab of a male terminal fitting. A barrel is behind the main portion and is configured to be connected with an end of a wire. A resilient contact piece is formed in the main portion, and a wall of the main portion is hammered to project at a position facing the resilient contact piece to define a pedestal-like receiving portion. The resilient contact piece deforms resiliently when the tab is inserted into the main portion and tightly holds the tab against the receiving portion for electrically connecting the two terminal fittings.

The above-described female terminal fitting strongly presses the tab against the receiving portion in the process of inserting the tab into the main portion due to a spring force from the resilient contact piece. Thus, large frictional resistance is produced between the receiving portion and the tab as the spring force of the resilient contact piece increases, thereby causing a problem of deteriorating operability. In contrast, operability is improved if the spring force of the resilient contact piece decreases, but a sufficient contact pressure to the tab cannot be ensured.

The invention was developed in view of the above situation and an object thereof is to ensure a sufficient contact pressure to a tab while improving operability while inserting the tab.

SUMMARY OF THE INVENTION

The invention relates to a female terminal fitting with a main portion for receiving a tab of a mating side. First and second resiliently deformable pieces are formed in the main portion and face one another in directions so that the first and second resiliently deformable pieces can deform toward and away from one another. The second resilient piece includes an extending piece, a support and a pressing piece. The extending piece extends substantially in an inserting direction of the tab from an opening end of a wall of the main portion. The support is held in contact with the inner surface of the wall at an extending end of the extending piece. The pressing piece extends from the support toward the first resilient piece and an extending end portion of the pressing piece holds the first resilient piece in a pre-loaded state.

The tab can be inserted between the extending piece and the first resilient piece. Thus, a leading end of the tab pushes and inclines the pressing piece and releases the pre-loaded state of the first resilient piece. Additionally, the extending piece deforms resiliently about the support and toward the first resilient piece as the pressing piece is pushed and inclined. Thus, the tab is held resiliently between the extending piece and the first resilient piece.

The first resilient piece remains in the pre-loaded state during the insertion of the tab until the pressing piece is pushed and inclined. Thus, the first resilient piece does not exert a large spring force on the tab and frictional resistance between the first resilient piece and the extending piece is low. Therefore, the tab can be inserted easily.

The leading end of the tab pushes and inclines the pressing piece to release the pre-loaded state of the first resilient piece. The extending piece deforms resiliently about the support and toward the first resilient piece as the pressing piece inclines. Thus, the tab is held resiliently and tightly between the extending piece and the first resilient piece. Accordingly, a high contact pressure is ensured between the first resilient piece, the extending piece and the tab.

The first resilient piece preferably extends substantially in the inserting direction of the tab from an opening end of wall of the main portion that faces the wall from which the second resilient piece extends.

The pressing piece preferably presses an extending end portion of the first resilient piece.

The first resilient piece preferably extends in the inserting direction of the tab from an opening end of first wall of the main portion and the second resilient piece preferably extends from a second wall, which faces the first wall. The pressing piece presses an extending end portion of the first resilient piece. Thus, the pressing piece need not exert a particularly large force and the first resilient piece released from the pre-loaded state can return smoothly to its original shape.

The extending end portion of the first resilient piece preferably is held tightly between the pressing piece and the inner surface of the first wall in the pre-loaded state. Thus, loose movements of the first resilient piece are restricted in the pre-loaded state.

The tab may be thicker than an opening dimension of an insertion path for the tab between the extending piece and the first resilient piece when the first resilient piece is in the pre-loaded state. Thus, the tab slides in contact with the first resilient piece and the extending piece during insertion of the tab into the insertion path. This sliding contact removes a layer, such as an oxide layer, formed on the surface of the first resilient piece, the extending piece or the tab.

Alternatively, the tab may be thinner than an opening dimension of an insertion path for the tab formed between the extending piece and the first resilient piece when the first resilient piece is in the pre-loaded state is set to be larger than the thickness of the tab. Thus, substantially no frictional resistance will be produced between the first resilient piece, the extending piece and the tab, and a work load during insertion of the tab into the insertion path is mitigated.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
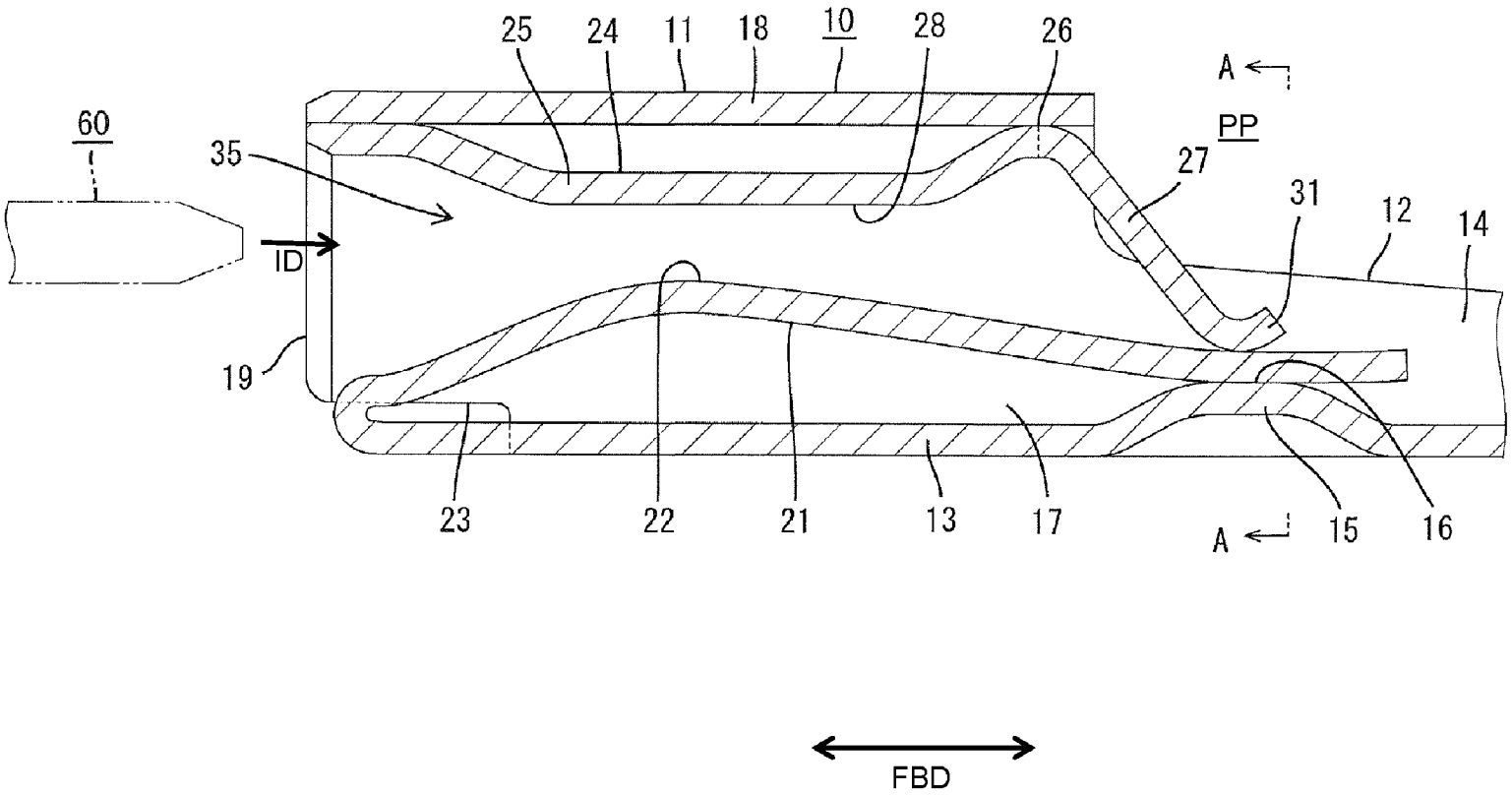
FIG. 1 is a sectional view of an essential part of a female terminal fitting according to one embodiment of the invention.
Figure 2:
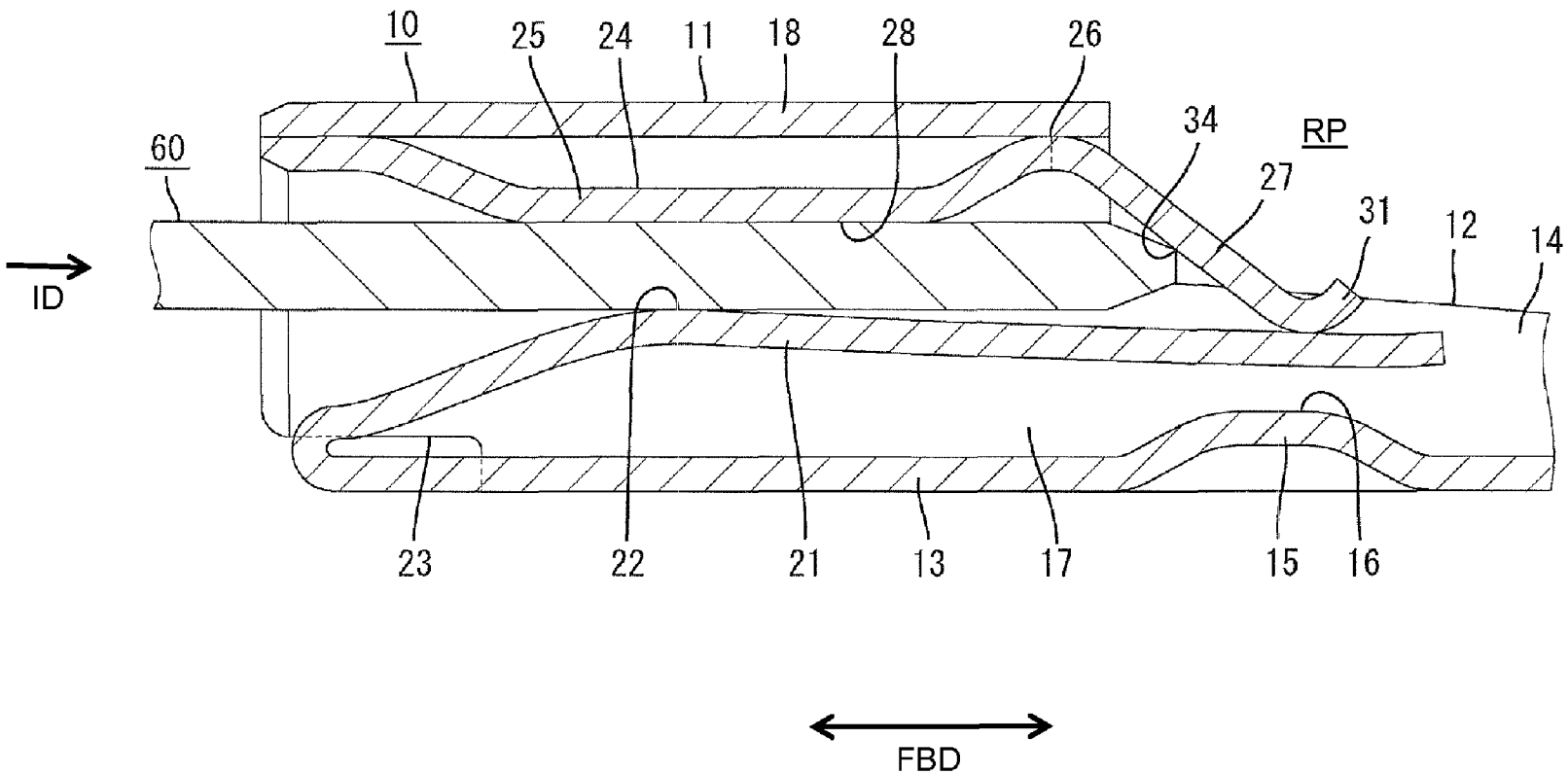
FIG. 2 is a sectional view of an essential part showing a state where a tab is inserted in a main portion.
Figure 3:
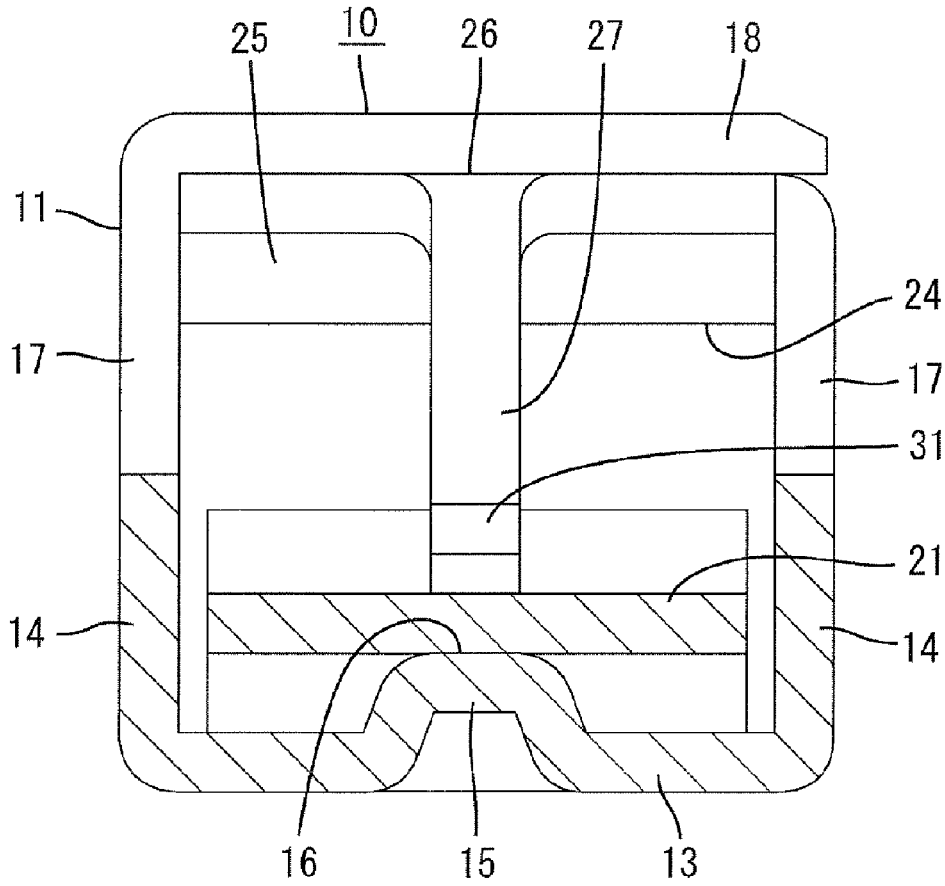
FIG. 3 is a sectional view along A-A of FIG. 1.

A female terminal fitting 10 according to the invention is identified by the numeral 10 in FIGS. 1 to 3. The female terminal fitting 10 is formed integrally or unitarily by applying bending, folding and/or embossing and other processings to an electrically conductive metal plate and includes a main portion 11, an unillustrated wire connection portion behind the main portion 11 and a coupling 12 between the wire connection portion and the main portion 11.

The wire connection portion is crimped or otherwise connected to an end of an unillustrated wire. A base plate 13 extends substantially in forward and backward directions FBD along the main portion 11, the coupling 12 and the wire connecting portion. The coupling 12 includes the base plate 13 and two coupling side plates 14 projecting up from opposite lateral sides of the base plate 13. The base plate 13 of the coupling 12 is hammered from below to project in and up to form a raised portion 15. The raised portion 15 is substantially a pedestal with a substantially horizontal flat upper surface 16.

The main portion 11 is a substantially rectangular tube and has the base plate 13, two side plates 17 projecting up from opposite lateral sides of the base plate 13 and a facing plate 18 bent at the upper end of one side plate 17 to extend toward the upper end of the other side plate 17, as shown in FIG. 3. The facing plate 18 is substantially parallel to the base plate 13. A tab insertion opening 19 is formed at the front of the main portion 11 and can receive a tab 60 of a mating side inserted in an inserting direction ID from the front. Lower portions of the rear ends of the side plates 17 are connected unitarily to the coupling side plates 14.

A substantially strip-shaped first resilient piece 21 is formed in the main portion 11 and is cantilevered rearward from the front end of the base plate 13 to extend substantially in forward and backward directions FBD. The first resilient piece 21 is resiliently deformable up and down in a direction intersecting the inserting direction ID with the front opening end of the base plate 13 as a support. The first resilient piece 21 is formed from a tongue that initially extends forward from the front end of the base plate 13. The tongue then is bent back in such a manner to define a substantially mountain shape for the first resilient piece 21. A contact 22 is defined at the peak of the mountain-shaped first resilient piece 21 and can be brought into contact with the tab 60. Slits 23 are formed between opposite sides of a front end of the base plate 13 and the side plates 17. Thus, the base end of the first resilient piece 21 is retracted slightly back from the front end of the main portion 11. A rear extending end of the first resilient piece 21 is supported on and in contact with the flat surface 16 of the raised portion 15 from above.

A substantially strip-shaped second resilient piece 24 is cantilevered rearward in the main portion 11 and extends in substantially forward and backward directions FBD at a position substantially facing the first resilient piece 21.

The second resilient piece 24 includes an extending piece 25, a support 26 and a pressing piece 27. The extending piece 25 extends back from the front end of the facing plate 18. The support 26 is at the rear end of the extending piece 25 and is held in contact with the inner surface of the facing plate 18. The pressing piece 27 extends obliquely down to the back from the support 26 toward the first resilient piece 21. The extending piece 25 and the support 26 are wide strips similar to the first resilient piece 21. On the other hand, the pressing piece 27 is a narrow strip extending from a widthwise intermediate part of the rear end of the extending piece 25 (see FIG. 3).

A front end of the extending piece 25 closely contacts the inner surface of the facing plate 18. A part of the extending piece 25 rearward of the front end is spaced from the inner surface of the facing plate 18 and includes a straight portion 28 that is substantially parallel with the inner surface of the facing plate 18. The straight portion 28 of the extending piece 25 faces the contact portion 22 of the first resilient piece 21 and extends forward and backward substantially parallel to the inserting direction ID.

The extending piece 25 extends obliquely up and back from the rear end of the straight portion 28 and the support 26 is formed at the upper and rearward end of this oblique rear part of the extending piece 25. The front part of the pressing piece 27 extends obliquely down back from the support 26. Thus, the support 26 is defined at a mountain-shaped peak where the oblique rear part of the extending piece 25 meets the oblique front part of the pressing piece 27. The support 26 is constantly in contact with the inner surface of the facing plate 18.

The rear end of the pressing piece 27 is bent obliquely up and back to define a bent-up portion 31. The convex lower surface defined by the bent-up portion 31 of the pressing piece 27 is biased into contact with the rear end portion of the first resilient piece 21 from above. Thus, the rear end portion of the first resilient piece 21 is held resiliently and tightly in a pressing position PP between the convex lower surface at the bent-up portion 31 and the raised portion 15 of the base plate 13, as shown in FIG. 1. The first resilient piece 21 pressed by the pressing piece 27 is deformed resiliently with the front end of the base plate 13 as a support and is held in this pre-loaded resiliently deformed state. An insertion path 35 for the tab 60 is formed between the extending piece 25 and the first resilient piece 21. A distance between the straight portion 28 of the extending piece 25 and the contact portion 22 of the first resilient piece 21 in a height direction defines an opening dimension of the insertion path 35 and is slightly smaller than the thickness of the tab 60 when the pressing piece 27 is at the pressing position PP.

The pressing piece 27 includes a touching portion 34 aligned with the insertion path 35. A leading end of the tab 60 will contact the touching portion 34 after sufficient insertion of the tab 60 into the main portion 11 along the insertion path 35. Thus, the tab 60 pushes the pressing piece 27 and pivots the pressing piece 27 back and up about the support 26. As a result, the convex lower surface of the pressing piece 27 will no longer bias the first resilient piece 21 against the raised portion 15 of the base plate 13. Accordingly, the pressing piece 27 is displaced from the pressing position PP of FIG. 1 to a retracted position RP (see FIG. 2) where the state of pressing the first resilient piece 21 is released.

The tab 60 is inserted into the main portion 11 of the female terminal fitting 10 along the inserting direction ID and from the front as an unillustrated connector that accommodates the female terminal fitting 10 is connected. More particularly, the tab 60 is inserted along forward and backward directions FBD through the tab insertion opening 19. A depth of insertion increases while the tab 60 slides in contact with the extending piece 25 and the first resilient piece 21. The pressing piece 27 is at the pressing position PP and the first resilient piece 21 is kept in the pre-loaded state as the leading end of the tab 60 moves along the insertion path 35. Thus, the tab 60 is not subjected to a large spring force from the first resilient piece 21 and there is low frictional resistance between the tab 60 and both the first resilient piece 21 and the extending piece 25.

The leading end of the tab 60 contacts with the touching portion 34 immediately before the tab 60 is inserted completely and hence the tab 60 inclines the pressing piece 27 back to the retracted position RP. This movement of the pressing piece 27 releases the first resilient piece 21 from the pre-loaded state. As a result, the first resilient piece 21 returns resiliently up toward the extending piece 25 in a pivoting movement about the front end of the base plate 13. Therefore, the first resilient piece 21 gives a spring force to the tab 60 from below.

The extending piece 25 is displaced down toward the first resilient piece 21 in a pivoting movement about the support 26 as the pressing piece 27 moves to the retracted position RP. Therefore, the straight portion 28 of the extending piece 25 is held in contact with the upper surface of the tab 60. A lever action is generated by an applied force at the touching portion 34, a fulcrum at the support 26 and a resulting force at the straight portion 28 to press the tab 60 down.

The tab 60 that has been inserted into the main portion 11 is held in close resilient contact with the extending piece 25 and in close resilient contact with the first resilient piece 21 at its lower side. As a result, the tab 60 is held with an appropriate contact pressure from opposite sides between the extending piece 25 and the first resilient piece 21.

As described above, the first resilient piece 21 is kept in the pre-loaded state while the tab 60 is being inserted. Thus, the tab 60 is not subjected to a large spring force from the first resilient piece 21 and no large frictional resistance is produced between the first resilient piece 21 and the extending piece 25. Therefore, the tab 60 is inserted easily.

The pre-loaded state of the first resilient piece 21 is released as the leading end of the tab 60 pushes and inclines the pressing piece 27. The extending piece 25 is deformed resiliently toward the first resilient piece 21 about the support 26 as the pressing piece 27 is inclined. Thus, the tab 60 is held resiliently and tightly between the extending piece 25 and the first resilient piece 21 with a sufficient contact pressure.

The pressing piece 27 presses the first resilient piece 21 at a rear end distant from the front support of the first resilient piece 21. Thus, the pressing piece 27 need not exert a particularly large force and the first resilient piece 21 released from the pre-loaded state returns smoothly towards its original shape.

Furthermore, the rear end portion of the first resilient piece 21 is held tightly between the pressing piece 27 and the flat surface 16 of the raised portion 15 of the base plate 13 in the pre-loaded state. Thus, loose movements of the first resilient piece 21 in the pre-loaded state are restricted. In this case, the spring force of the first resilient piece 21 and the length of the pressing piece 27 are set at appropriate values by adjusting the height of the raised portion 15.

The tab 60 slides in contact with the first resilient piece 21 and the extending piece 25 during the insertion of the tab 60 along the insertion path 35. Thus, a layer, such as an oxide layer, formed on the surface of the first resilient piece 21, the extending piece 25 or the tab 60 can be removed by wiping or scratching.

The invention is not limited to the above described and illustrated embodiment. For example, the following embodiments are also included in the technical scope of the present invention.

Contrary to the above embodiment, the opening dimension of the insertion path between the extending piece and the first resilient piece may exceed the thickness of the tab when the pressing piece is at the pressing position and the first resilient piece is in the pre-loaded state. Thus, substantially no frictional resistance is produced between the first resilient piece, the extending piece and the tab, and a work load to insert the tab into the insertion path can be mitigated more.

The first resilient piece may extend forward from the rear end of the main portion and may be resiliently deformable with the rear end as a support.

The raised portion may be formed in the main portion or may be formed to extend from the main portion to the coupling.

The pressing piece may partly have the same width as the extending piece.

What is claimed is:

1. A female terminal fitting, comprising:

a main portion with an open front end and opposite first and second walls extending rearward from the front end;

a resiliently deformable first resilient piece extending rearward from the open front end of the main portion and disposed between the first and second walls; and a resiliently deformable second resilient piece formed in the main portion between the first resilient piece and the second wall, the second resilient piece including an extending piece, a support and a pressing piece, the extending piece extending rearward from a position in proximity to front end of the main portion, the support being at a rear end of the extending piece and being in contact with an inner surface of the second wall, the pressing piece extending from the support to the first resilient piece and holding the first resilient piece in a pre-loaded state.

2. The female terminal fitting of claim 1, wherein the pressing piece is pivotable about the support and toward the second wall for simultaneously deforming the extending piece toward the first resilient piece and releasing the pre-loaded state of the first resilient piece, whereby a tab inserted into the main portion contacts and pivots the pressing piece about the support and toward the second wall for simultaneously deforming the extending piece toward the first resilient piece and releasing the pre-loaded state of the first resilient piece, so that the first and second resilient pieces resiliently contact opposite surfaces of the tab.

3. The female terminal fitting of claim 1, wherein the first resilient piece extends unitarily from a portion of the first wall at the open front end of the main portion.

4. The female terminal fitting of claim 1, wherein the pressing piece presses an extending rear end portion of the first resilient piece in the pre-loaded state.

5. The female terminal fitting of claim 4, wherein the extending rear end portion of the first resilient piece is held tightly between the pressing piece and the inner surface of the second wall in the pre-loaded state.

6. The female terminal fitting of claim 1, wherein a minimum distance between the extending piece and the first resilient piece when the first resilient piece is in the pre-loaded state is smaller than a thickness of a tab to be inserted into the main portion.

7. The female terminal fitting of claim 1, wherein a minimum distance between the extending piece and the first resilient piece when the first resilient piece is in the pre-loaded state is larger than a thickness of a tab to be inserted into the main portion.

8. The female terminal fitting of claim 1, wherein the pressing piece is displaceable between a pressing position where the pressing piece gives a pressing force to the first resilient piece and a retracted position where the state of pressing the first resilient piece is released.

9. The female terminal fitting of claim 1, wherein the pressing piece is narrower than the extending piece in directions normal to a deformable direction of the second resilient piece and normal to a front to rear direction to facilitate deflection of the pressing piece about the support.

10. The female terminal fitting of claim 1, wherein the pressing piece extends obliquely rearward from the support.

* * * * *